US009707617B2

(12) United States Patent
Yamagata et al.

(10) Patent No.: US 9,707,617 B2
(45) Date of Patent: Jul. 18, 2017

(54) PRESS-FORMING METHOD

(71) Applicant: NIPPON STEEL & SUMITOMO METAL CORPORATION, Tokyo (JP)

(72) Inventors: Mitsuharu Yamagata, Tokyo (JP); Shuji Yamamoto, Tokyo (JP); Yasuhiro Wada, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 204 days.

(21) Appl. No.: 14/425,552

(22) PCT Filed: Nov. 7, 2013

(86) PCT No.: PCT/JP2013/080101

§ 371 (c)(1),
(2) Date: Mar. 3, 2015

(87) PCT Pub. No.: WO2014/073602

PCT Pub. Date: May 15, 2014

(65) Prior Publication Data

US 2015/0231688 A1 Aug. 20, 2015

(30) Foreign Application Priority Data

Nov. 9, 2012 (JP) ..... 2012-247286

(51) Int. Cl.
*B21D 22/22* (2006.01)
*B21J 5/02* (2006.01)
(Continued)

(52) U.S. Cl.
CPC ..... *B21J 5/025* (2013.01); *B21D 22/22* (2013.01); *B21D 22/24* (2013.01); *B21J 13/02* (2013.01)

(58) Field of Classification Search
CPC ..... B21D 22/20; B21D 22/22; B21D 24/04; B21D 24/10; B21D 22/00; B21D 22/24; B21J 5/025; B21J 13/02
See application file for complete search history.

(56) References Cited

U.S. PATENT DOCUMENTS 6,290,447 B1 * 9/2001 Siemonsen ..... B21D 51/44 413/56
6,701,603 B2 * 3/2004 Matsuura ..... H02K 1/17 29/421.1
(Continued)

FOREIGN PATENT DOCUMENTS

JP 64-49326 U 3/1989
JP 7-185726 A 7/1995
(Continued)

OTHER PUBLICATIONS

English translation of International Preliminary Report on Patentability and Written Opinion of the International Searching Authority (Forms PCT/IB/338, PCT/IB/373 and PCT/ISA/237), dated May 21, 2015, for International Application No. PCT/JP2013/080101.
(Continued)

*Primary Examiner* — Edward Tolan
(74) *Attorney, Agent, or Firm* — Birch, Stewart, Kolasch & Birch, LLP

(57) ABSTRACT

While a compression part (B1) in a bottom wall part of a cup-shaped workpiece (B) is compressed by an inner punch (11) and an inner die (14) and moved in a direction to get away from an intermediate die (15), the inner die (14) is pushed toward the inner punch (11); and a compression part (B2) being an outer end portion in a radial direction of the workpiece (B) is compressed by an outer punch (13) and an outer die (16) and moved in an direction to approach the intermediate die (15), to thereby suppress the workpiece (B) in the compression part (B2) from material-flowing in a direction to get away from a central axis (10), whereby thickness reduction processing of the compression part (B1) and thickness increase processing of a vertical wall part (B3) of the workpiece (B) sandwiched by an intermediate punch (12) and the inner die (15) and a vertical wall part (B4) of
(Continued)

the workpiece (B) sandwiched by the intermediate punch (12) and an outer die (16) are performed.

4 Claims, 10 Drawing Sheets

(51) Int. Cl.
*B21J 13/02* (2006.01)
*B21D 22/24* (2006.01)

(56) References Cited

U.S. PATENT DOCUMENTS

| | | | | |
|---|---|---|---|---|
| 7,264,611 | B2 * | 9/2007 | Christenson ..... | A61M 5/14276 604/151 |
| 2006/0042344 | A1 * | 3/2006 | Bathurst ..... | B21D 51/38 72/379.4 |
| 2006/0236741 | A1 * | 10/2006 | Saitou ..... | B21D 53/26 72/348 |

FOREIGN PATENT DOCUMENTS

| | | | |
|---|---|---|---|
| JP | 10-296377 | A | 11/1998 |
| JP | 2000-301284 | A | 10/2000 |
| JP | 2000-317565 | A | 11/2000 |
| JP | 2004-322104 | A | 11/2004 |

OTHER PUBLICATIONS

International Search Report, issued in PCT/JP2013/080101, dated Feb. 10, 2014.
Written Opinion of the International Searching Authority, issued in PCT/JP2013/080101, dated Feb. 10, 2014.

* cited by examiner

PRESS-FORMING METHOD

TECHNICAL FIELD

The present invention relates to a press-forming method used for a workpiece which is formed into a cup shape.

BACKGROUND ART

As a gear component used for a transmission or the like of a vehicle, a cup-shaped component having a vertical wall part and a bottom wall part (including a bottom wall part with a boss) is known. The vertical wall part is required to be formed to be thick-walled in order to form a gear. Conventionally, a cup-shaped component having a thick-walled vertical wall part has not been able to be manufactured by being press-formed once by using a press mold. Therefore, the cup-shaped component has been manufactured by manufacturing a thick-walled plate material and a thin-walled plate material individually and joining the above by welding.

CITATION LIST

Patent Literature

Patent Literature 1: Japanese Laid-open Patent Publication No. 10-296377

Patent Literature 2: Japanese Laid-open Patent Publication No. 2004-322104

Patent Literature 3: Japanese Laid-open Patent Publication No. 2000-317565

Patent Literature 4: Japanese Laid-open Patent Publication No. 2000-301284

SUMMARY OF INVENTION

Technical Problem

However, productivity is bad in the above method since it is required to weld different members. Thus, an object of the invention of the present application is to manufacture a cup-shaped workpiece having a thick-walled vertical wall part efficiently.

Solution to Problem

In order to solve the aforementioned problem, a first invention according to the invention of the present application is a press-forming method using a press mold which includes an inner punch, an intermediate punch disposed along an outer periphery of the inner punch, an outer punch disposed along an outer periphery of the intermediate punch, an inner die, an intermediate die disposed along an outer periphery of the inner die, and an outer die disposed along an outer periphery of the intermediate die, a central axis of each of which is disposed coaxially, and in which the inner punch, the intermediate punch, and the outer punch are disposed to face the inner die, the intermediate die, and the outer die, respectively, the method having:

while compressing a first compression part in a bottom wall part of a workpiece formed into a cup shape by the inner punch and the inner die and moving the first compression part in a direction to get away from the intermediate die, pushing the inner die toward the inner punch; and compressing a second compression part being an outer end portion in a radial direction of the workpiece by the outer punch and the outer die and moving the second compression part in a direction to approach the intermediate die, to thereby suppress the workpiece in the second compression part from material-flowing in a direction to get away from the central axis, whereby thickness reduction processing of the first compression part and thickness increase processing of a vertical wall part of the workpiece sandwiched by the intermediate punch and the inner die and a vertical wall part of the workpiece sandwiched by the intermediate punch and the outer die are performed.

In order to solve the aforementioned problem, a second invention according to the invention of the present application is characterized in that, in the first press-forming method of the invention of the present application, a protruding part restraining an outer periphery of the workpiece formed into the cup shape is provided in the outer punch or in the outer die, to thereby restrain the workpiece from material-flowing in the direction to get away from the central axis in the second compression part being the outer end portion in the radial direction of the workpiece.

In order to solve the aforementioned problem, a third invention according to the invention of the present application is a press-forming method using a press mold which includes an inner punch, an intermediate punch disposed along an outer periphery of the inner punch, an outer punch disposed along an outer periphery of the intermediate punch, an inner die, an intermediate die disposed along an outer periphery of the inner die, and an outer die disposed along an outer periphery of the intermediate die, a central axis of each of which is disposed coaxially, and in which the inner punch, the intermediate punch, and the outer punch are disposed to face the inner die, the intermediate die, and the outer die, respectively, the method having:

performing thickness reduction processing by compressing a first compression part in a bottom wall part of a workpiece formed into a cup shape by the inner punch and the inner die; and while sandwiching the first compression part having been reduced in thickness by the inner punch and the inner die and moving the first compression part in a direction to get away from the intermediate die, compressing a second compression part being an outer end portion in a radial direction of the workpiece by the outer punch and the outer die and moving the second compression part in a direction to approach the intermediate die, to thereby suppress the second compression part from material-flowing in a direction to get away from the central axis, whereby thickness increase processing of a vertical wall part of the workpiece sandwiched by the intermediate punch and the inner die and a vertical wall part of the workpiece sandwiched by the intermediate punch and the outer die are performed.

In order to solve the aforementioned problem, a fourth invention according to the invention of the present application is characterized in that, in the third press-forming method of the invention of the present application, a protruding part restraining an outer periphery portion of the workpiece formed into the cup shape is provided in the outer punch or in the outer die, to thereby restrain the workpiece from material-flowing in the direction to get away from the central axis in the second compression part being the outer end portion in the radial direction of the workpiece.

Advantageous Effects of Invention

According to the present invention, it is possible to manufacture a cup-shaped workpiece (cup-shaped molded product) having a thick-walled vertical wall part efficiently.

DESCRIPTION OF EMBODIMENTS

First Embodiment

Figure 1:
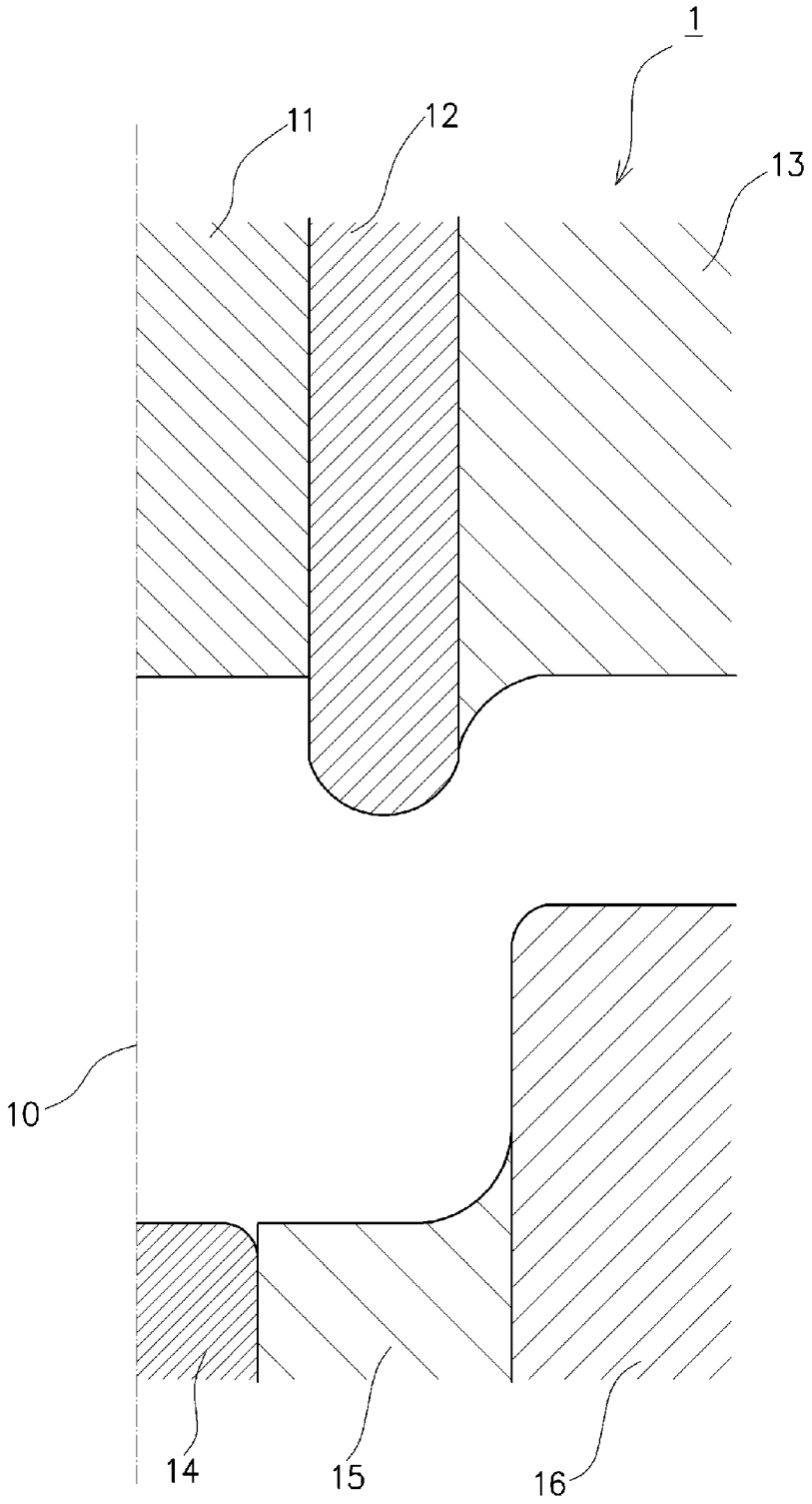
FIG. 1 is a schematic diagram of a press-forming apparatus.

FIG. 1 is a schematic diagram of a press-forming apparatus. In the present embodiment, as a result that a press work is performed by using a press-forming apparatus 1 to a workpiece of a cup shape (hereinafter, referred to as a cup-shaped workpiece), thickness reduction and thickness increase processing is performed. Here, the cup-shaped workpiece is a bottomed cylindrical processing material having a bottom wall part and a vertical wall part formed in an outer edge of the bottom wall part, and also includes a cup-shaped workpiece with a boss in which a boss-shaped part is formed in a bottom wall part as described later.

The press-forming apparatus 1, as a press mold, has an inner punch 11, an intermediate punch 12, an outer punch 13, an inner die 14, an intermediate die 15, and an outer die 16. These inner punch 11, intermediate punch 12, outer punch 13, inner die 14, intermediate die 15, and outer die 16 can be each raised and lowered independently. Note that press-forming similar to that in a case of raising and lowering the punches 11 to 13 and dies 14 to 16 independently is also possible by fixing the intermediate die 15 and moving the inner punch 11, the intermediate punch 12, the outer punch 13, the inner die 14, and the outer die 16 relatively to the intermediate die 15, for example.

The intermediate punch 12 is disposed along an outer periphery of the inner punch 11. The outer punch 13 is disposed along an outer periphery of the intermediate punch 12. The intermediate die 15 is disposed along an outer periphery of the inner die 14. The outer die 16 is disposed along an outer periphery of the intermediate die 15. Central axes 10 indicated by a dashed line of the respective inner punch 11, intermediate punch 12, outer punch 13, inner die 14, intermediate die 15, and outer die 16 are provided coaxially. The inner punch 11 is positioned above the inner die 14 and the inner punch 11 and the inner die 14 are disposed to face each other. The intermediate punch 12 is positioned above the intermediate die 15 and the intermediate punch 12 and the intermediate die 15 are disposed to face each other. The outer punch 13 is positioned above the outer die 16 and the outer punch 13 and the outer die 16 are disposed to face each other.

The inner punch 11 is set so that a size in a direction orthogonal to the central axis 10 (hereinafter, referred to a radial direction) is larger than that of the inner die 14. A front end portion of the inner punch 11 is formed into a flat shape extending in the radial direction. Here, the front end portion of the inner punch 11 means a lower end portion of the inner punch 11. In a front end portion of the inner die 14 is formed a die shoulder portion curved more downward as getting away from the central axis 10 in the radial direction. The front end portion of the inner die 14 means an upper end portion of the inner die 14.

A front end portion of the intermediate punch 12 is formed so that its cross-sectional shape is of an arc shape protruding downward. The front end portion of the intermediate punch 12 means a lower end portion of the intermediate punch 12. The intermediate die 15 has a flat shape portion extending in the radial direction and a die shoulder portion extending from an end portion of the flat shape portion and curved more upward as getting away from the central axis 10 in the radial direction. The intermediate die 15 is set so that a size in the radial direction is larger than the intermediate punch 12. Further, the flat shape portion projects in a region directly below the inner punch 11, while the die shoulder portion projects in a region directly below the outer punch 13. In other words, the intermediate die 15 is disposed to face all of the front end portion of the intermediate punch 12, a part of an outer periphery side of the front end portion of the inner punch 11, and a part of an inner periphery side of the front end portion of the outer punch 13 in a vertical direction. Further, the front end portion of the intermediate punch 12 is not limited to one whose cross-sectional shape is of the aforementioned arc shape, but the front end portion of the intermediate punch 12 can be one whose cross-sectional shape is a shape which has a flat shaped center portion extending in the radial direction and punch shoulder portions curved upward in both ends thereof, for example.

The inner periphery side of a front end portion of the outer punch 13 protrudes on a side nearer to the central axis 10 than the outer die 16. In the front end portion of the outer punch 13 is formed a punch shoulder portion curved more downward as approaching the central axis 10. Here, the front end portion of the outer punch 13 means a lower end portion of the outer punch 13. In a front end portion of the outer die 16 is formed a die shoulder portion curved more downward as approaching the central axis 10. The front end portion of the outer die 16 means an upper end portion of the outer die 16.

Figure 2:
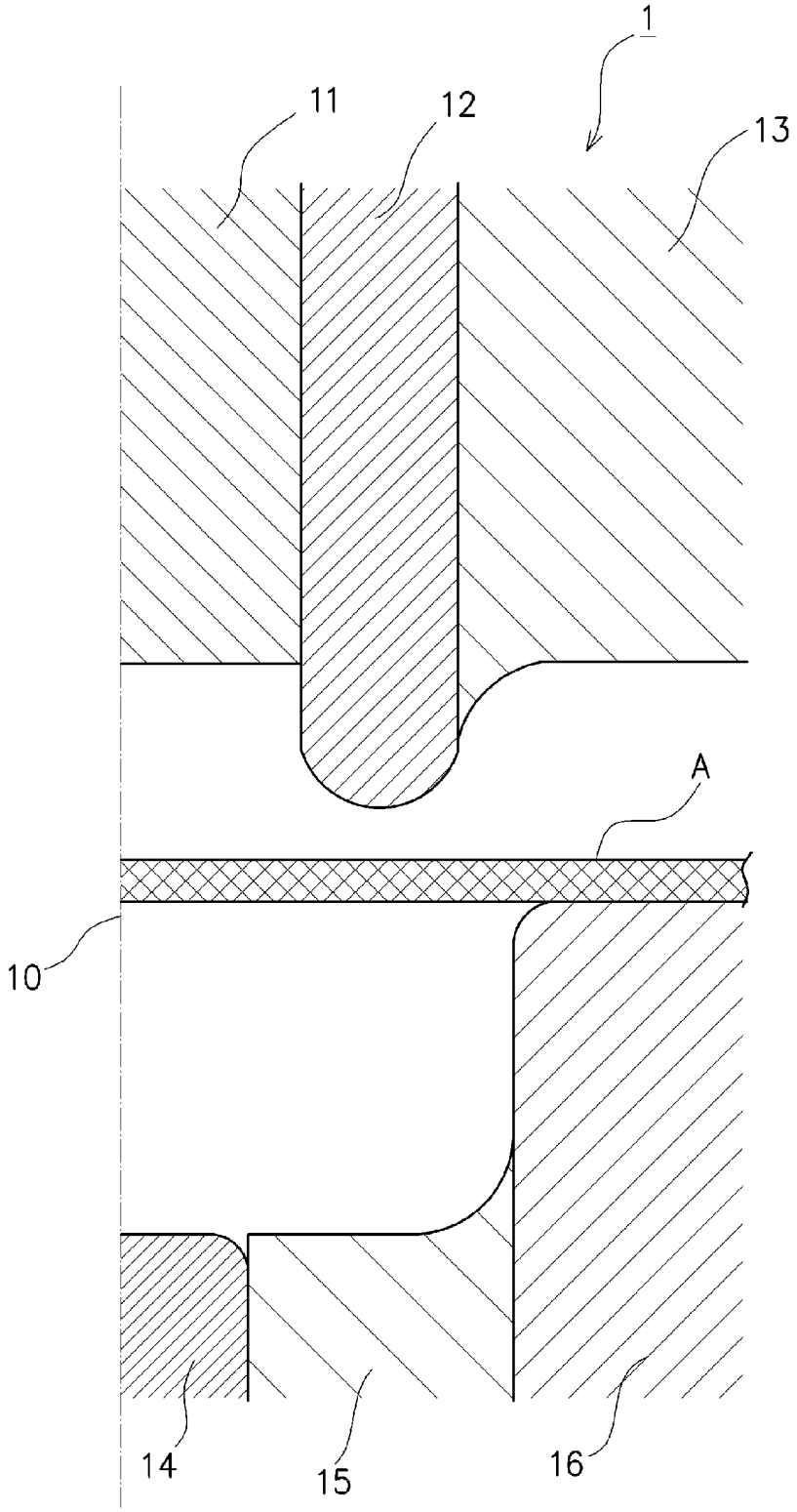
FIG. 2 is an action explanatory diagram of the press-forming apparatus (an initial state in a pre-process step)
Figure 3:
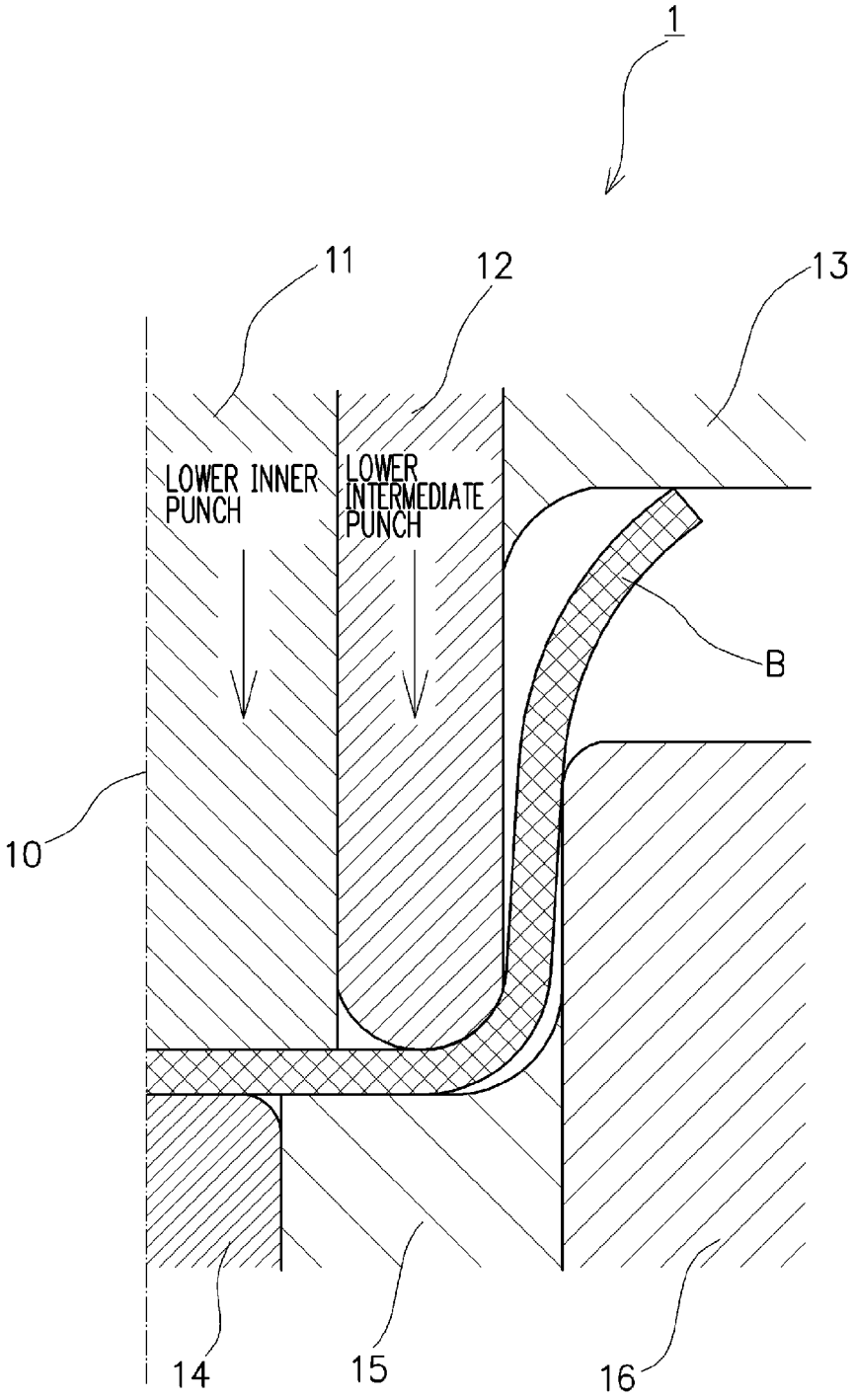
FIG. 3 is an action explanatory diagram of the press-forming apparatus (a state at a time of drawing in the pre-process step)

Next, a processing method (hereinafter, referred to as a pre-process step) of processing a disk-shaped workpiece A into a cup-shaped workpiece B will be described with reference to FIG. 2 and FIG. 3. First, as illustrated in FIG. 2, the disk-shaped workpiece A is set on the outer die 16 of the press-forming apparatus 1 and the inner punch 11 and the intermediate punch 12 are lowered toward the disk-shaped workpiece A. When the inner punch 11 and the intermediate punch 12 are further lowered after contact with the disk-shaped workpiece A, the disk-shaped workpiece A is drawn into a cup shape and the cup-shaped workpiece B is formed, as illustrated in FIG. 3. Note that in a state illustrated in FIG. 3, neither thickness reduction processing nor thickness increase processing is performed to the cup-shaped workpiece B which has been formed from the disk-shaped workpiece A.

Next, with reference to FIG. 4 and FIG. 5, there will be described a thickness reduction thickness increase process step in which thickness reduction and thickness increase processing is performed to the cup-shaped workpiece B. Here, a region including the central axis 10 in a bottom wall part of the cup-shaped workpiece B is referred to as a first compression part B1 and an end portion (that is, an outer side end portion in the radial direction) on a side to get away from the central axis 10 is referred to as a second compression part B2. Further, a wall part positioned between the intermediate punch 12 and the inner die 14 of the cup-shaped workpiece B is referred to as a vertical wall part B3, and a wall part positioned between the intermediate punch 12 and the outer die 16 of the cup-shaped workpiece B is referred to as a vertical wall part B4.

Figure 4:
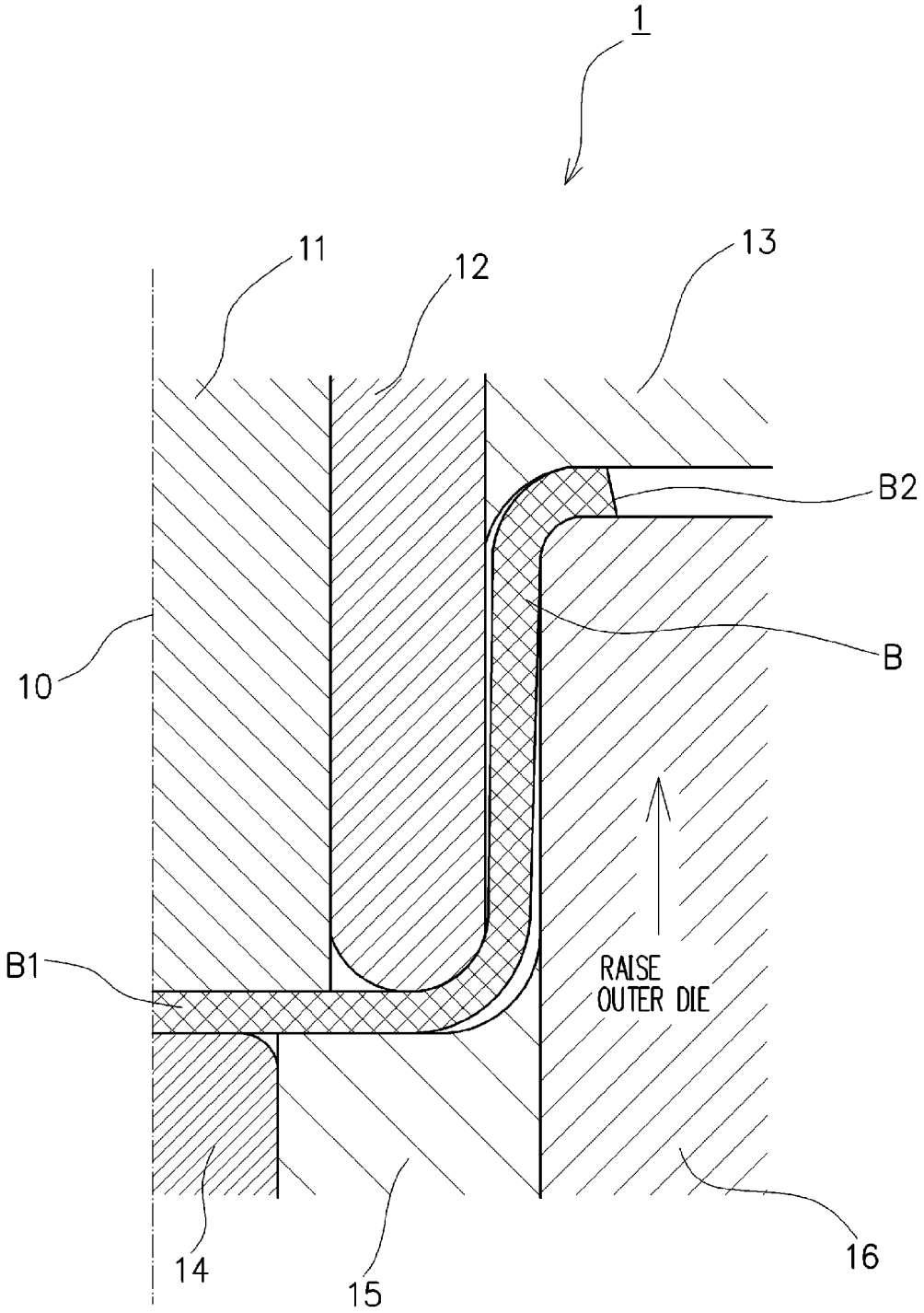
FIG. 4 is an action explanatory diagram of the press-forming apparatus (a state just before performing a thickness reduction thickness increase process step)
Figure 5:
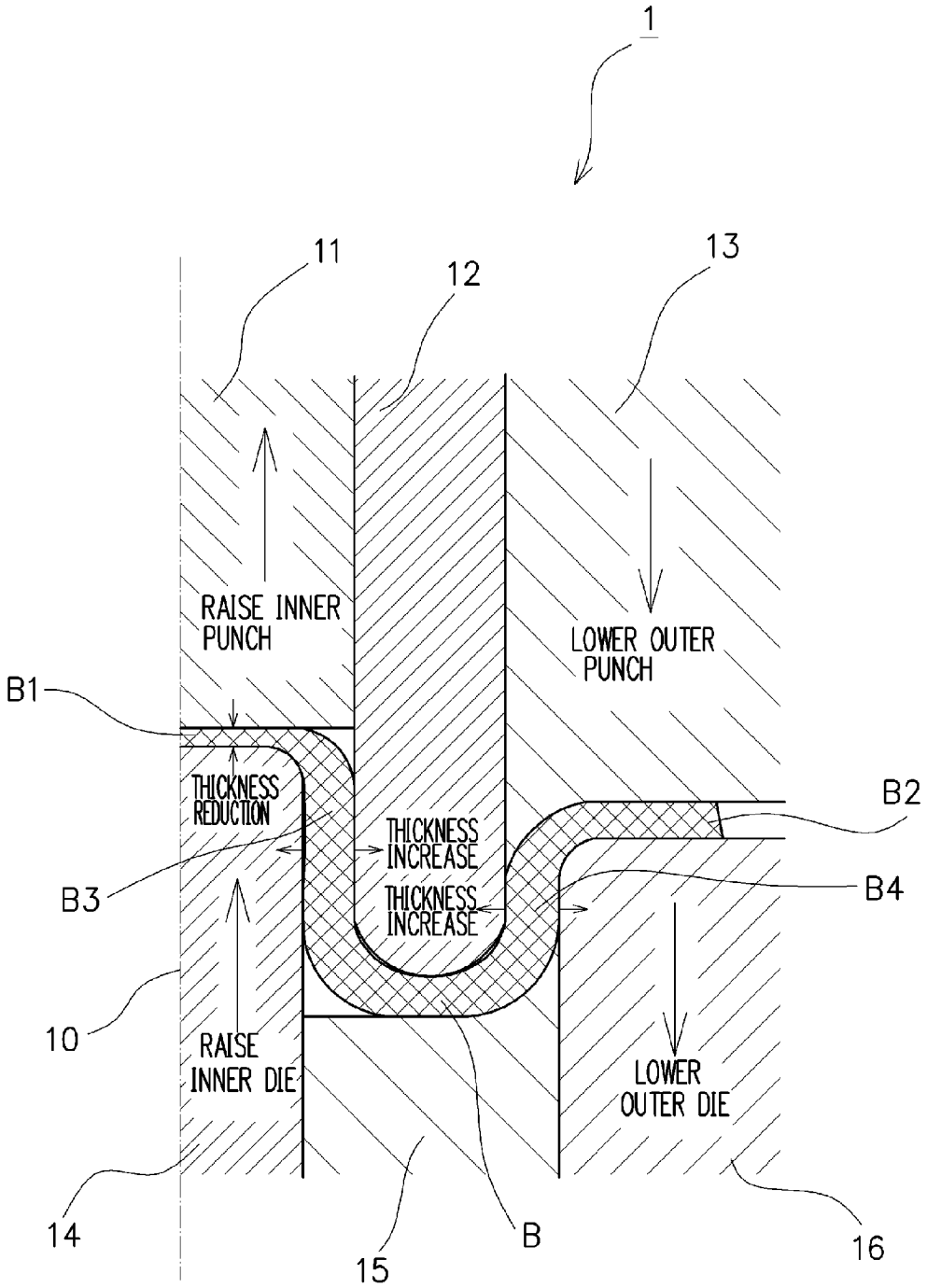
FIG. 5 is an action explanatory diagram of the press-forming apparatus (a state at a time of the thickness reduction thickness increase process step)

First, as illustrated in FIG. 4, the outer die 16 is raised in a state where the outer punch 13 is halted, so that the second compression part B2 of the cup-shaped workpiece B is compressed by using the outer punch 13 and the outer die 16. Subsequently, as illustrated in FIG. 5, the inner punch 11 and the inner die 14 compressing the first compression part B1 are raised so that the first compression part B1 is moved in a direction to get away from the intermediate die 15. By pushing the inner die 14 toward the inner punch 11 during the above, the thickness reduction processing of reducing the first compression part B1 in thickness is performed. Further, together with the thickness reduction processing, the outer punch 13 and the outer die 16 compressing the second compression part B2 are lowered so that the second compression part B2 of the cup-shaped workpiece B is moved in a direction to approach the intermediate die 15. As a result of suppressing the second compression part B2 from material-flowing in a direction to get away from the central axis 10 by performing the above, the thickness increase processing of increasing the vertical wall part B3 and the vertical wall part B4 of the cup-shaped workpiece B in thickness is performed.

In other words, as a result that a material is flown from a large portion of a circumference of a space between the intermediate punch 12 and the intermediate die 15 into the vertical wall part B3, radial reduction occurs. Thereby, based on a constant volume relationship, the vertical wall part B3 is lengthened and increased in thickness in a plate thickness direction. Further, as a result that the first compression part B1 compressed by the inner punch 11 and the inner die 14 is reduced in thickness, the material is flown into the vertical wall part B3, and the vertical wall part B3 is increased in thickness. The vertical wall part B4 is increased in thickness since mainly a length in a height direction is shortened.

According to the aforementioned method, the vertical wall part B3 and the vertical wall part B4 can be substantially increased in thickness only by press-forming the cup-shaped workpiece B. The cup-shaped workpiece B having been subjected to thickness reduction thickness increase processing is shaped, and thereafter used for a component of a transmission of a vehicle, or the like. Explanation of a process step of shaping will be omitted.

Modification Example 1

Figure 6:
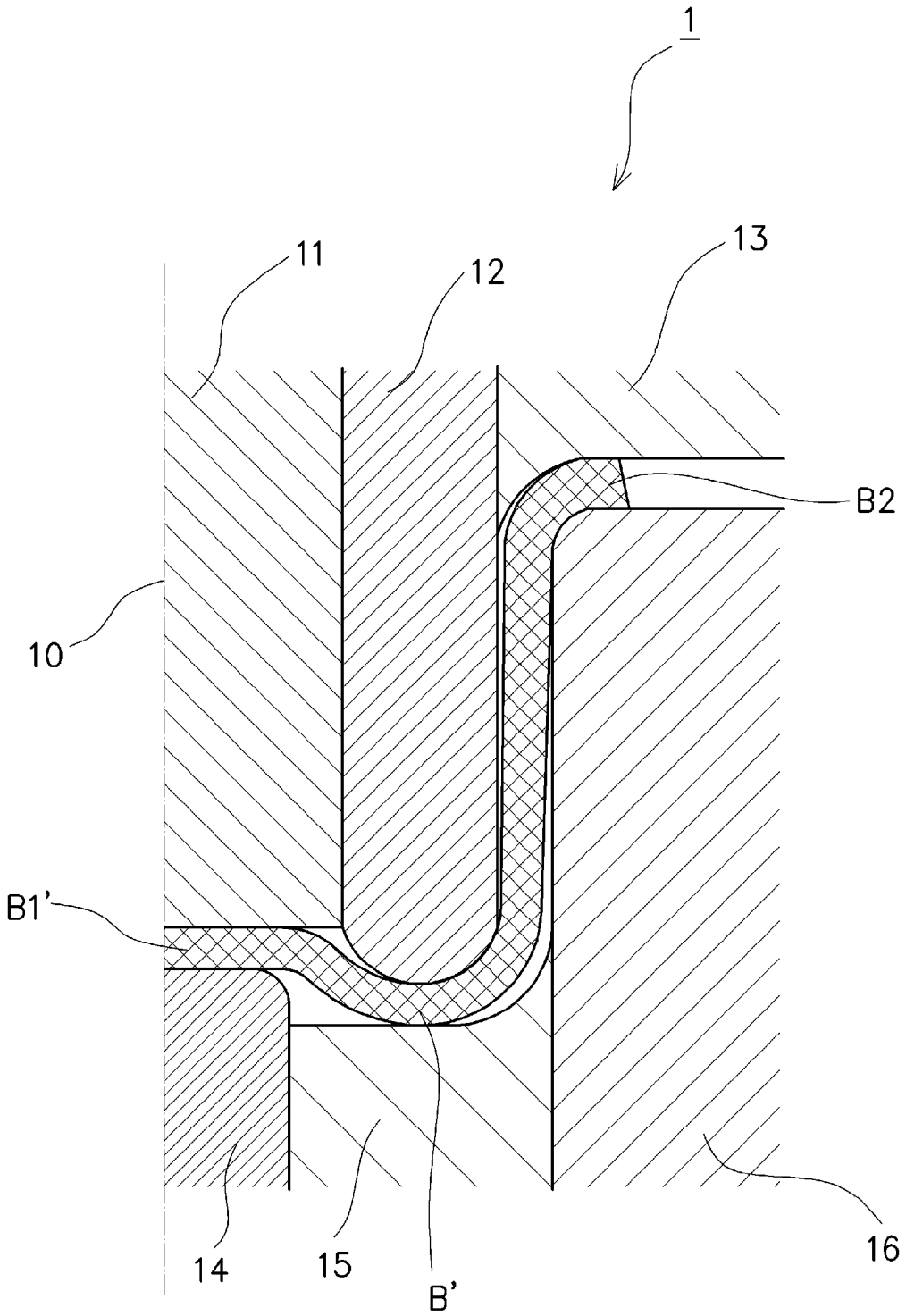
FIG. 6 shows a cup-shaped workpiece of a modification example 1.

In the aforementioned embodiment, a case where the bottom wall part of the cup-shaped workpiece B is flat in the radial direction is explained, but the present invention is not limited thereto. FIG. 6 corresponds to FIG. 4 and shows a cup-shaped workpiece B' of a modification example 1. As shown in FIG. 6, the cup-shaped workpiece of the present invention also includes the cup-shaped workpiece B' with a boss which has a boss-shaped part B1' formed on a center side in a radial direction of a bottom wall part, protruding toward a cup inner side, and lower in height than a second compression part B2. In such a case, the boss-shaped part B1' corresponds to the first compression part B1 in the aforementioned embodiment.

Modification Example 2

In the aforementioned embodiment, the inner punch 11, the intermediate punch 12, and the outer punch 13 are disposed on an upper side while the inner die 14, the intermediate die 15, and the outer die 16 are disposed on a lower side, but the present invention is not limited thereto, and disposition of up and down can be reversed. In such a case, while an inner punch 11 and an inner die 14 compressing a first compression part B1 are lowered, the inner die 14 is pushed toward the inner punch 11. Further, an outer punch 13 and an outer die 16 compressing a second compression part B2 are raised to suppress material-flowing in the second compression part B2. Thereby, it is possible to perform thickness reduction thickness increase processing similar to that in the aforementioned embodiment.

Second Embodiment

In the first embodiment, at a time of the thickness reduction thickness increase processing of the cup-shaped workpiece, the thickness reduction processing of the first compression part B1 is performed while the inner punch 11 and the inner die 14 are moved in the direction to get away from the intermediate die 15, but in the present embodiment, thickness reduction processing of a first compression part B1 is performed at a timing different from that of the first embodiment. An apparatus constitution of a press-forming apparatus 1 used in the present embodiment is similar to that of the first embodiment, and explanation will not be repeated.

Figure 7:
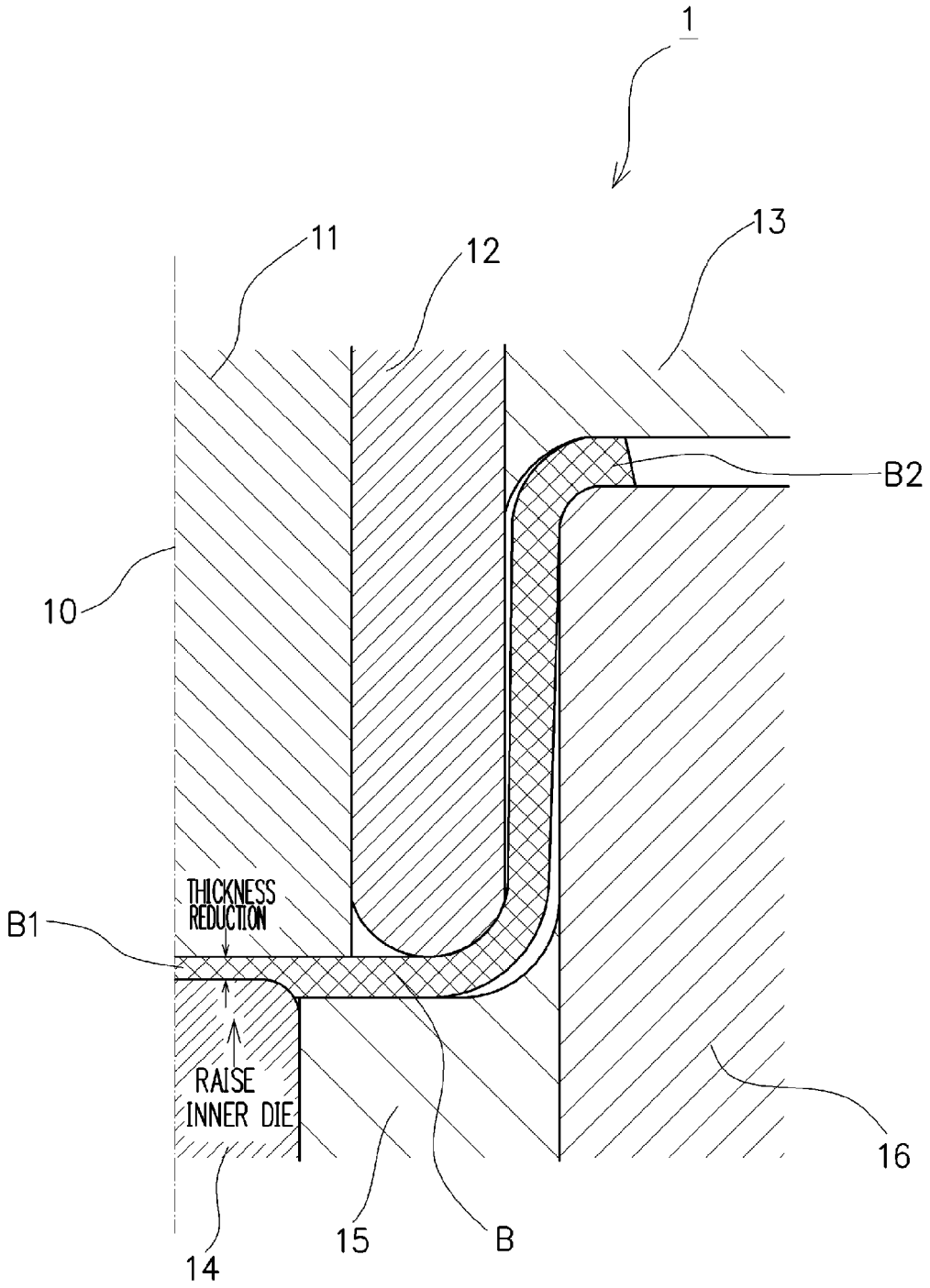
FIG. 7 is an action explanatory diagram of a press-forming apparatus of a second embodiment (a state at a time of thickness reduction process step)

First, similarly to in the first embodiment, a cup-shaped workpiece B is press-formed in accordance with process steps illustrated in FIG. 2 to FIG. 4. Next, with reference to FIG. 7, the inner die 14 is raised in a state where the inner punch 11 is halted, so that the first compression part B1 is compressed by the inner punch 11 and the inner die 14, and thickness reduction is performed. A method is also possible in which the first compression part B1 is compressed by the inner punch 11 and the inner die 14 by lowering the inner punch 11 in a state where the inner die 14 is halted, to perform thickness reduction. Further, a method is also possible in which the first compression part B1 is compressed by the inner punch 11 and the inner die 14 by raising the inner die 14 and lowering the inner punch 11, to perform thickness reduction.

Subsequently, with reference to FIG. 8, the inner punch 11 and the inner die 14 compressing the first compression part B1 are raised so that the first compression part B is moved in a direction to get away from the intermediate die 15. Besides, an outer punch 13 and an outer die 16 compressing a second compression part B2 are lowered so that the second compression part B2 of the cup-shaped workpiece B is moved in a direction to approach the intermediate die 15, to suppress the second compression part B2 from material-flowing in a direction to get away from a central axis 10. Thereby, thickness increase processing of increasing a vertical wall part B3 and a vertical wall part B4 of the cup-shaped workpiece B in thickness is performed. However, the thickness reduction processing of the first embodiment, that is, the thickness reduction processing of reducing the first compression part B1 in thickness by pushing the inner die 14 toward the inner punch 11 is completed in the process step shown in FIG. 7, and is not repeatedly performed in the process step of FIG. 8. In other words, in the present embodiment, after the thickness reduction processing of the first compression part B1 is performed, the thickness increase processing of the vertical wall part B3 and the vertical wall part B4 is performed.

According to the aforementioned method, the vertical wall part B3 and the vertical wall part B4 can be substantially increased in thickness only by press-forming the cup-shaped workpiece B. The cup-shaped workpiece B having been subjected to thickness reduction thickness increase processing is shaped, and thereafter used for a component of a transmission of a vehicle, or the like. Explanation of a process step of shaping will be omitted.

Modification Example 3

Figure 8:
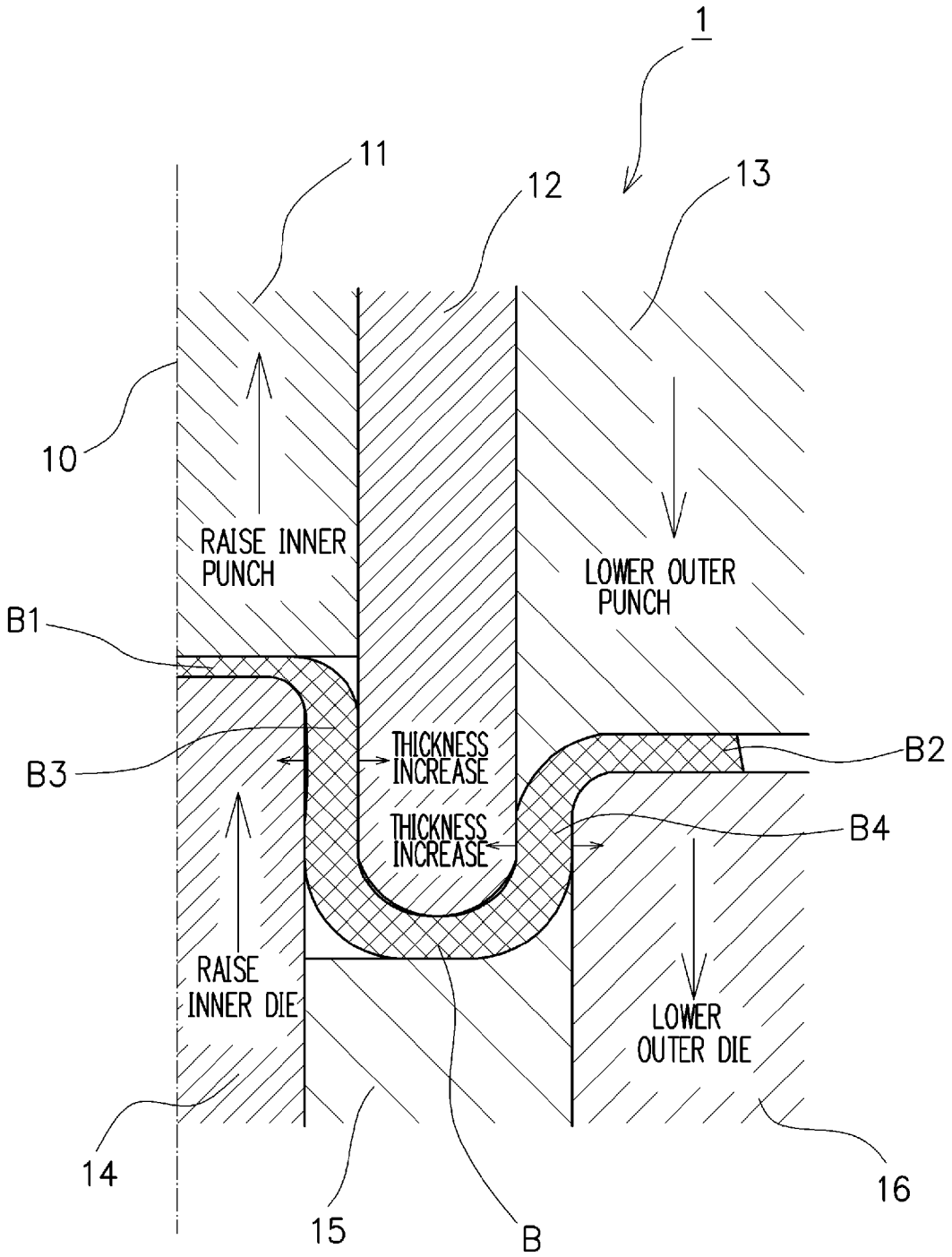
FIG. 8 is an action explanatory diagram of the press-forming apparatus of the second embodiment (a state at a time of thickness increase process step)

In the present embodiment, before performing the thickness increase process step illustrated in FIG. 8, the thickness reduction processing of reducing the first compression part B1 in thickness is performed, but the present invention is not limited thereto, and can include a thickness reduction process step of reducing a first compression part B1 in thickness while performing a thickness increase process step similarly to in the first embodiment. In such a case, the thickness reduction processing is performed in two stages of before the thickness increase process step and during the thickness increase process step.

Modification Example 4

In the aforementioned embodiment, the press-forming apparatus 1 is used when the disk-shaped workpiece A is formed into the cup-shaped workpiece B, but the present invention is not limited thereto and another press-forming apparatus can be used. In other words, different press-forming apparatuses may be used in the process step of forming the disk-shaped workpiece A into the cup-shaped workpiece B and in the thickness reduction thickness increase process step.

Modification Example 5

In the aforementioned embodiment, the punch shoulder portion curved downward as approaching the central axis 10 is formed in the front end portion of the outer punch 13. In contrast, a front end portion of an outer punch 13 may be formed into a flat shape extending in a radial direction. Thickness reduction thickness increase processing is possible similarly even in such a case. Further, by making the front end portion of the outer punch 13 into the flat shape instead of a curved shape, a flow resistance of a material is increased, so that it is possible to further suppress a second compression part B2 from material-flowing in a direction to get away from the central axis 10.

Third Embodiment

Figure 9:
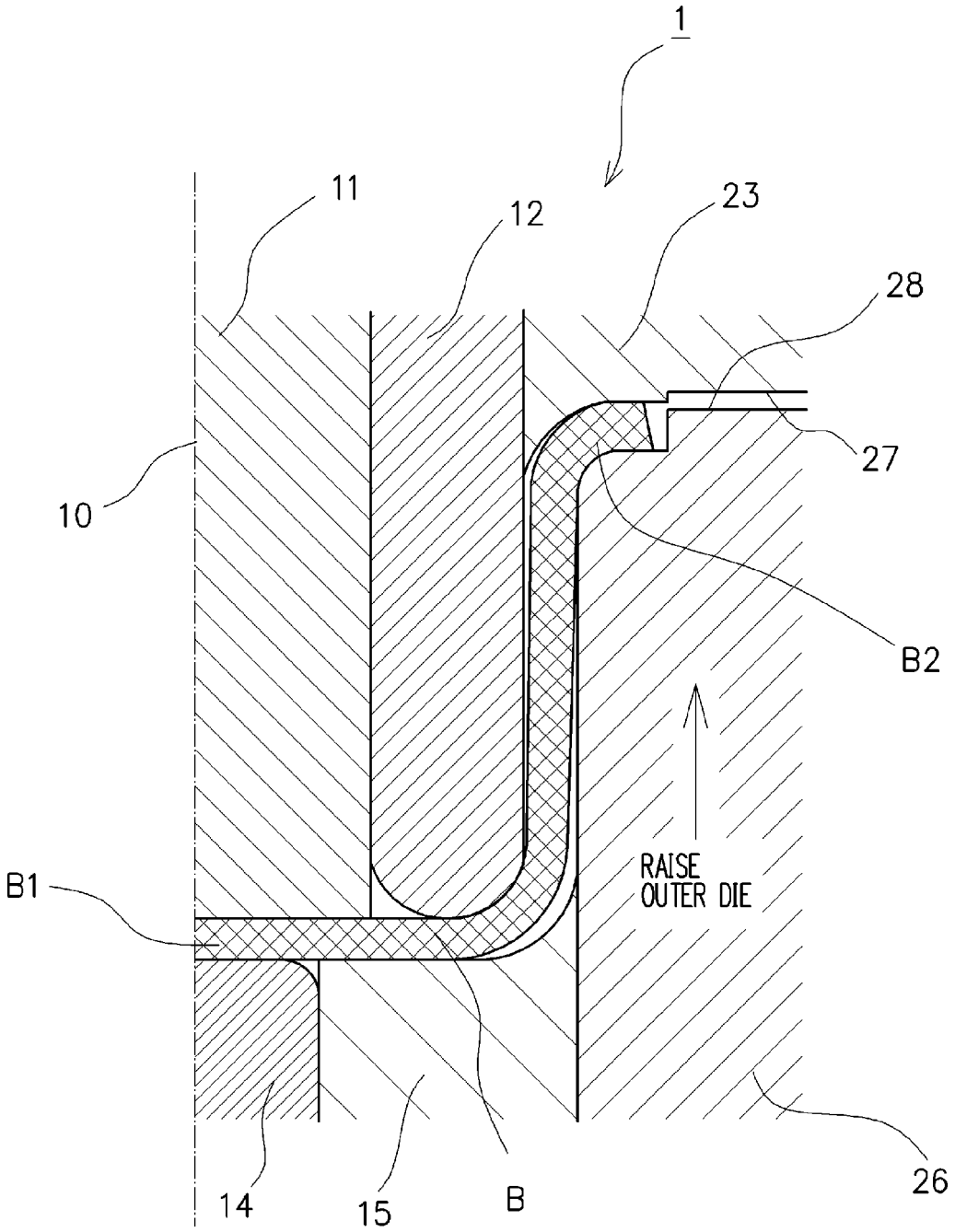
FIG. 9 is an explanatory diagram of a press-forming apparatus of a third embodiment (a state before compression of a compression part B2)
Figure 10:
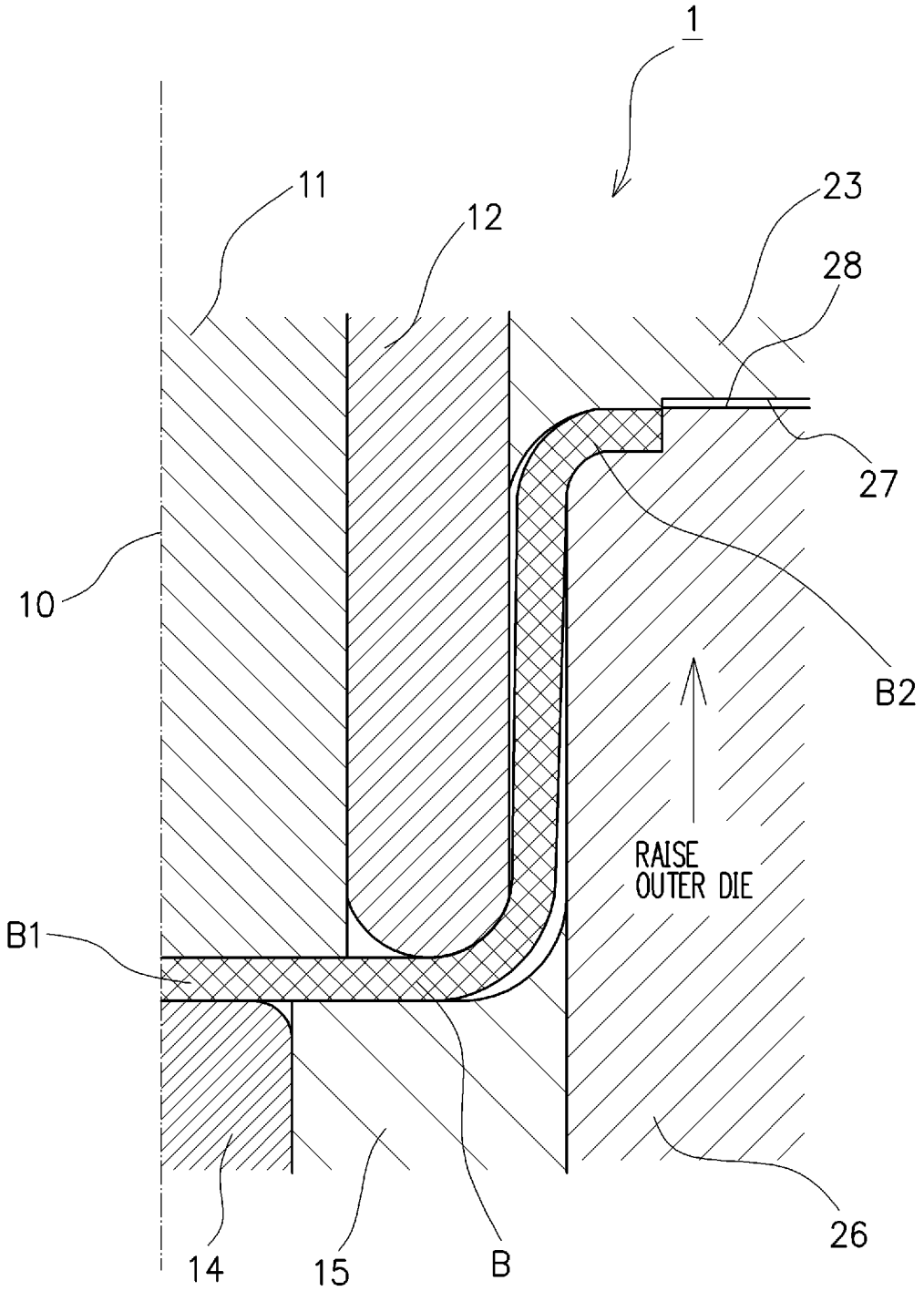
FIG. 10 is an explanatory diagram of the press-forming apparatus of the third embodiment (a state at a time of compression of the compression part B2).

In the first or second embodiment, in order to further suppress the second compression part B2 from material-flowing in the direction to get away from the central axis 10, it is necessary to raise a frictional resistance. In order to raise the frictional resistance, there is a method of raising the frictional resistance by changing a lubrication state or of raising a load to compress the cup-shaped workpiece B of the outer punch 13 and the outer die 16. On the other hand, the frictional resistance is a function of a load and a value which can be taken is limited depending on a constraint condition such as a maximum load of a press-forming apparatus 1 and a forming plate thickness of a second compression part B2. In contrast, in a third embodiment shown in FIG. 9, when a second compression part B2 is to be compressed as in FIG. 10, the second compression part B2 being an outer periphery portion of the cup-shaped workpiece B is restrained by an outer die protruding part 28 provided in an outer die 26, to restrain material-flowing in a direction to get away from a central axis 10. As a result, material-flowing to vertical wall parts B3 and B4 (see FIG. 5, FIG. 8) of the cup-shaped workpiece B is increased, so that a thickness increase ratio can be heightened.

Modification Example 6

In the aforementioned embodiment, the outer die protruding part 28 is provided in the outer die 26, and an outer punch recessed part 27 in which the outer die protruding part 28 is to be housed is provided in an outer punch 23 facing the outer die 26. In contrast, in a case where a load capacity of a press-forming apparatus 1 is sufficiently high and an outer punch 23 and an outer die 26 do not open during forming, it is possible to use the outer punch 13 shown in FIG. 1 without providing an outer punch recessed part 27.

Modification Example 7

In the aforementioned embodiment, the recessed part is disposed in the outer punch 23 and the protruding part is disposed in the outer die 26, but the present invention is not limited thereto and disposition of up and down can be reversed. In such a case, forming similar to in the aforementioned embodiment can be performed with a mold constitution in which a protruding part is disposed in an outer punch 23 and a recessed part is disposed in an outer die 26.

The invention claimed is:

1. A press-forming method using a press mold which includes an inner punch, an intermediate punch disposed along an outer periphery of the inner punch, an outer punch disposed along an outer periphery of the intermediate punch, an inner die, an intermediate die disposed along an outer periphery of the inner die, and an outer die disposed along an outer periphery of the intermediate die, a central axis of each of which is disposed coaxially, and in which the inner punch, the intermediate punch, and the outer punch are disposed to face the inner die, the intermediate die, and the outer die, respectively, the method comprising:

while compressing a first compression part in a bottom wall part of a workpiece formed into a cup shape by the inner punch and the inner die and moving the first compression part in a direction away from the intermediate die, pushing the inner die toward the inner punch; and compressing a second compression part being an outer end portion in a radial direction of the workpiece by the outer punch and the outer die and moving the second compression part in a direction to approach the intermediate die, to thereby suppress the workpiece in the second compression part from material-flowing in a direction away from the central axis, whereby thickness reduction processing of the first compression part and thickness increase processing of a vertical wall part of the workpiece sandwiched by the intermediate punch and the inner die and a vertical wall part of the workpiece sandwiched by the intermediate punch and the outer die are performed.

2. The press-forming method according to claim 1, wherein a protruding part restraining an outer periphery of the workpiece formed into the cup shape is provided in the outer punch or in the outer die, to thereby restrain the workpiece from material-flowing in the direction away from the central axis in the second compression part being the outer end portion in the radial direction of the workpiece.

3. A press-forming method using a press mold which includes an inner punch, an intermediate punch disposed along an outer periphery of the inner punch, an outer punch disposed along an outer periphery of the intermediate punch, an inner die, an intermediate die disposed along an outer periphery of the inner die, and an outer die disposed along an outer periphery of the intermediate die, a central axis of each of which is disposed coaxially, and in which the inner punch, the intermediate punch, and the outer punch are disposed to face the inner die, the intermediate die, and the outer die, respectively, the method comprising:

performing thickness reduction processing by compressing a first compression part in a bottom wall part of a workpiece formed into a cup shape by the inner punch and the inner die; and while sandwiching the first compression part having been reduced in thickness by the inner punch and the inner die and moving the first compression part in a direction away from the intermediate die, compressing a second compression part being an outer end portion in a radial direction of the workpiece by the outer punch and the outer die and moving the second compression part in a direction to approach the intermediate die, to thereby suppress the second compression part from material-flowing in a direction away from the central axis, whereby thickness increase processing of a vertical wall part of the workpiece sandwiched by the intermediate punch and the inner die and a vertical wall part of the workpiece sandwiched by the intermediate punch and the outer die are performed.

4. The press-forming method according to claim 3, wherein a protruding part restraining an outer periphery portion of the workpiece formed into the cup shape is provided in the outer punch or in the outer die, to thereby restrain the workpiece from material-flowing in the direction away from the central axis in the second compression part being the outer end portion in the radial direction of the workpiece.

* * * * *